United States Patent [19]

Boudreau et al.

[11] Patent Number: 4,839,563

[45] Date of Patent: Jun. 13, 1989

[54] PULSE BURST PANEL DRIVE FOR ELECTROLUMINESCENT DISPLAYS

[75] Inventors: Robert A. Boudreau, Hampton; Robert E. Brown, Stratham, both of N.H.

[73] Assignee: GTE Products Corporation, Danvers, Mass.

[21] Appl. No.: 55,493

[22] Filed: May 28, 1987

[51] Int. Cl.[4] ..... G09F 9/00

[52] U.S. Cl. ..... 315/169.3; 340/781; 340/825.81

[58] Field of Search ..... 315/169.3, 169.2, 107; 340/781, 825.81, 805; 250/578

[56] References Cited

U.S. PATENT DOCUMENTS

| | | | |
|---|---|---|---|
| 3,813,575 | 5/1974 | Webb | 315/167 |
| 3,869,646 | 3/1975 | Kirton et al. | 315/246 |
| 3,889,151 | 6/1975 | Hanak et al. | 315/170 |
| 3,908,150 | 9/1975 | Webb | 315/167 |
| 3,975,661 | 8/1976 | Kanatani et al. | 340/805 |
| 4,275,336 | 6/1981 | Marrello et al. | 315/169.3 |
| 4,594,589 | 6/1986 | Ohba et al. | 340/805 |
| 4,686,426 | 8/1987 | Fujioka et al. | 315/169.3 |

OTHER PUBLICATIONS

T. Kawada et al, "A Symmetric Drive with Low Voltage Drivers for ac TFEL," *Japan Display*, '86, pp. 272–275.

*Display Driver Handbook*, Texas Instruments, 1983, pp. 2–33 to 2–39.

*Primary Examiner*—Palmer C. DeMeo
*Assistant Examiner*—T. Salindong
*Attorney, Agent, or Firm*—William R. McClellan; Martha Ann Finnegan

[57] ABSTRACT

A thin film electroluminescent display device energized with a rapid burst of pulses during a time less than the decay time of the phosphor yields substantially increased light output. Preferably, a burst of between two and forty pulses having a duration in the range between 5 and 20 microseconds and having alternating polarities is applied to the device. The pulse burst technique is advantageously applied to a dot matrix type EL display panel operating at a 60 Hz refresh rate. For a 512×256 element display panel, each row is addressed for approximately 65 microseconds, and four pulses of about 12–15 microseconds each are applied to the EL pixels during each row address time. The pulse burst technique provides increased brightness while minimizing the retained image problem.

20 Claims, 10 Drawing Sheets

PULSE BURST PANEL DRIVE FOR ELECTROLUMINESCENT DISPLAYS

FIELD OF THE INVENTION

This invention relates to methods and apparatus for energizing electroluminescent displays and, more particularly, to methods and apparatus for energizing electroluminescent displays with a burst of pulses in order to increase the light output of the display.

BACKGROUND OF THE INVENTION

Electroluminescent display panels have gained acceptance as alphanumeric displays for portable computers and for other portable systems requiring displays because of their small size, light weight and desirable display characteristics. Electroluminescent (EL) display panels are not as large as cathode ray tubes and do not have the disadvantages of liquid crystal displays such as a small viewing angle and sensitivity to ambient lighting conditions. Electroluminescent display panels are also used in automobiles and aircraft cockpits.

Electroluminescent display panels are typically configured as a two-dimensional array of individual EL devices, or pixels, each having a row connection and a column connection. The individual devices include a light emitting phosphor layer, typically of manganese doped zinc sulfide, sandwiched between dielectric layers. Electrodes for applying energizing voltages, including at least one transparent electrode, are attached to the dielectric layers. In order to produce light, the individual EL devices require the application of a voltage above a threshold magnitude and having transitions of alternating polarity. The resultant light output requires approximately 0.5 to 1 millisecond to decay to 1/e of peak brightness following an applied voltage pulse. EL display panels are typically time multiplexed by rows and are operated at a 60 Hz refresh rate.

The first generation of thin film electroluminescent drive electronics utilized scanning of one row of the display at a time at a sufficiently high frame rate to reproduce a visible display on the panel. As each row is addressed, selected pixels are addressed in parallel on column electrodes. A prior art asymmetric drive technique provided the EL panel with alternating polarity drive pulses by applying a negative subthreshold voltage to one row at a time. During each row scan time, a positive voltage pulse is applied to the selected columns, and zero voltage is applied to the nonselected columns. At the intersection of the selected columns and the selected row, the pixel receives the voltage necessary for light emission. At the intersection of the nonselected columns, the pixels are at or below the threshold voltage and do not emit light. After all rows of the panel have been addressed, a positive polarity refresh pulse is applied to all of the rows simultaneously, and all columns are held at zero volts potential. The asymmetric drive technique provides two peaks of light from each selected pixel for each frame of the display. For the typical 60 Hz refresh rate, light is emitted from selected pixels at a 120 Hz rate.

The disadvantage of the asymmetric drive technique is that a d.c. net charge results on nonselected pixels. The net charge over a period of time produces permanent damage to the display. A fixed pattern displayed for a long period can produce a change in the pixel threshold voltage versus brightness, known as differential aging. When this occurs, previously selected pixels become brighter than nonselected pixels, resulting in a retained image. The retained image is undesirable to users.

To reduce the effect of retained image, a symmetrical drive scheme was developed. In the symmetrical drive scheme, the refresh pulse is eliminated and alternating polarity drive pulses are applied to the panel. To maintain alternating polarity drive, the rows are scanned with pulses of alternating polarity on even and odd frames. The alternating polarity produces a net zero charge on all display pixels, thereby reducing retained image. However, since the refresh pulse is eliminated, light pulses from selected pixels occur at a 60 Hz rate, and the brightness of the display is reduced by 50%.

One way to increase the light output of an EL display panel is to increase the refresh rate of the display so that the average light output perceived by the viewer is increased. This approach has several disadvantages. The standard refresh rate utilized by computers is 60 Hz. To increase the refresh rate would require storage in a semiconductor memory circuit of the 60 Hz frame data received from the computer. In addition, extensive circuitry is required for retrieval and display of the stored data. The extra circuitry complicates the panel assembly and adds to its cost.

It is a general object of the present invention to provide improved methods and apparatus for energizing electroluminescent display devices and panels.

It is another object of the present invention to provide electroluminescent display apparatus with a high light output level.

It is a further object of the present invention to provide electroluminescent display apparatus having little or no retained image.

It is yet another object of the present invention to provide methods and apparatus for energizing electroluminescent display devices utilizing a burst of energizing pulses to increase output brightness.

It is still another object of the present invention to provide methods and apparatus for operating electroluminescent display panels with increased brightness at a refresh rate of 60 Hz.

SUMMARY OF THE INVENTION

Our invention is based on the discovery that the brightness of an electroluminescent display device can be significantly increased by energizing it with a rapid burst of pulses of alternating polarity, rather than a single pulse. It is known that the electroluminescent phosphors in an EL device require from 0.5 to 1.0 milliseconds to decay to 1/e of peak brightness following stimulation with a voltage pulse. It is also known that increasing the frame rate of an EL display increases its brightness since the average light output as integrated by the observer's eye is increased. It was thought necessary to allow the light output from an EL device to decrease to some fraction of peak brightness before a second voltage pulse was applied. Contrary to expectations, we have found that a rapid burst of pulses applied during a time less than the decay time of the phosphor yields substantially increased light output from the EL device. This discovery is advantageously utilized to increase the brightness of a multiplexed electroluminescent display panel.

According to the present invention, the above and other objects and advantages are achieved in electroluminescent display apparatus comprising at least one thin film electroluminescent display device having a pair of electrodes and being responsive to the application between the electrodes of a voltage above a threshold voltage of the display device to emit a light pulse having a prescribed decay time and drive means for applying between the electrodes of the display device during the decay time at least two energizing pulses.

Preferably, the energizing pulses include a burst of between 2 and 40 pulses, each having a minimum duration of 5 microseconds. It is also preferred that the pulses in the burst have alternating polarity so that the applied voltage is symmetrical about ground potential.

According to another aspect of the invention, there is provided an electroluminescent display apparatus comprising a plurality of thin film electroluminescent display devices arranged to form a display panel and drive circuit means for time multiplexed energizing of the display devices during sequential time intervals of a display frame to form a desired image on the display panel. Each display device includes a pair of electrodes and is responsive to application between the electrodes of a voltage above a threshold voltage of the display device to emit a light pulse having a prescribed decay time. The drive circuit means includes means for applying between the electrodes of selected display devices during each of the time intervals at least two energizing pulses. In a preferred embodiment utilizing a 512×256 element display panel operating at a 60 Hz refresh rate, four energizing pulses are applied to addressed pixels during each 65 microsecond row enable time interval.

According to yet another aspect of the present invention, there is provided a method for energizing an electroluminescent display panel comprising a plurality of thin film electroluminescent display devices. The method includes the steps of energizing the display devices during sequential time intervals of a display frame to form a desired image on the display panel and applying between electrodes of selected display devices during each of the time intervals at least two energizing pulses.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1A:
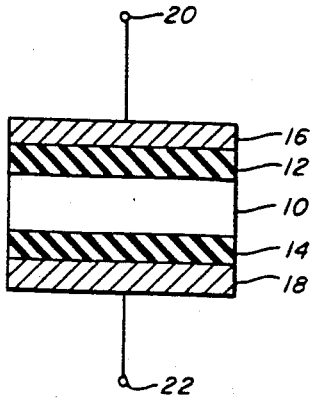
FIG. 1A is a cross-sectional view of an EL device in accordance with the prior art.

A typical electroluminescent display device is illustrated in cross-section in FIG. 1A. A phosphor layer 10 is usually manganese doped zinc sulfide. Dielectric layers 12 and 14 are formed on opposite sides of the phosphor layer 10 and conductive electrodes 16 and 18 are formed on the dielectric layers 12, 14, respectively. The conductive electrode on the viewing side must be a transparent material such as indium tin oxide. A display panel is formed of a plurality of display devices such as shown in FIG. 1A arranged in a two-dimensional dot matrix pattern of rows and columns. The individual display devices, or pixels, are selectively illuminated to provide a desired display image which is variable with time. The conductive electrode 16 of each pixel is connected to a column conductor 20 for the column in which the pixel is located. The conductive electrode 18 of each pixel is connected to a row conductor 22 for the row in which the pixel is located. By energizing the appropriate column conductor and row conductor, each pixel in the display panel can be addressed.

Figure 1B:
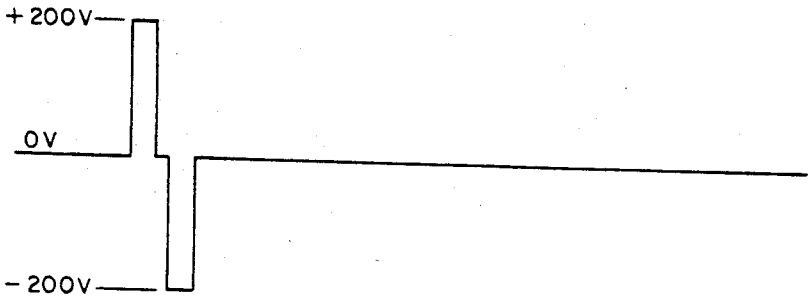
FIG. 1B illustrates a voltage for energizing an EL device in accordance with the prior art.
Figure 1C:
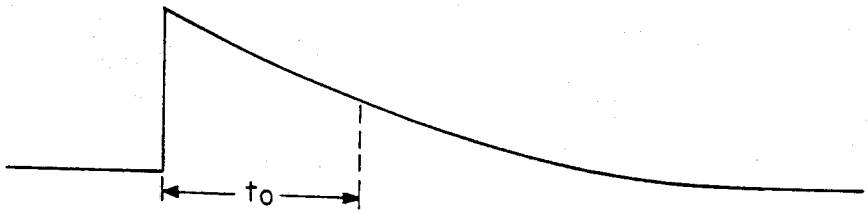
FIG. 1C illustrates the light output of the EL device for the voltage of FIG. 1B.
Figure 2:
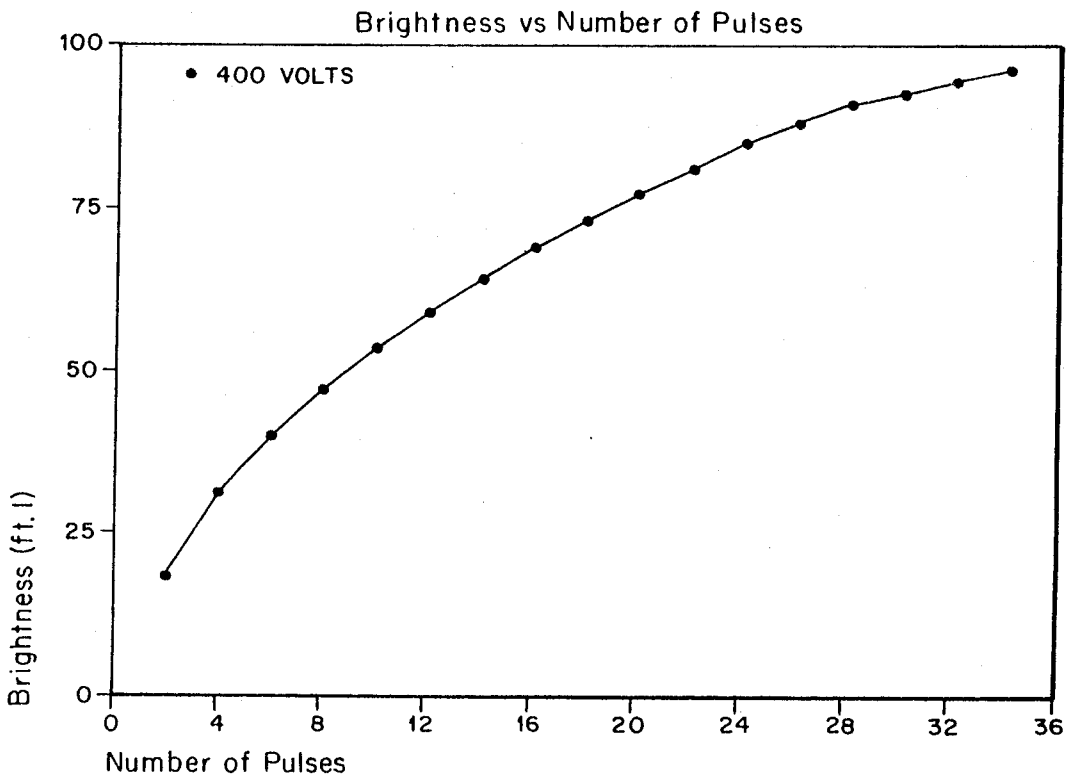
FIG. 2 is a plot of brightness of an EL device as a function of the number of pulses applied.
Figure 3:
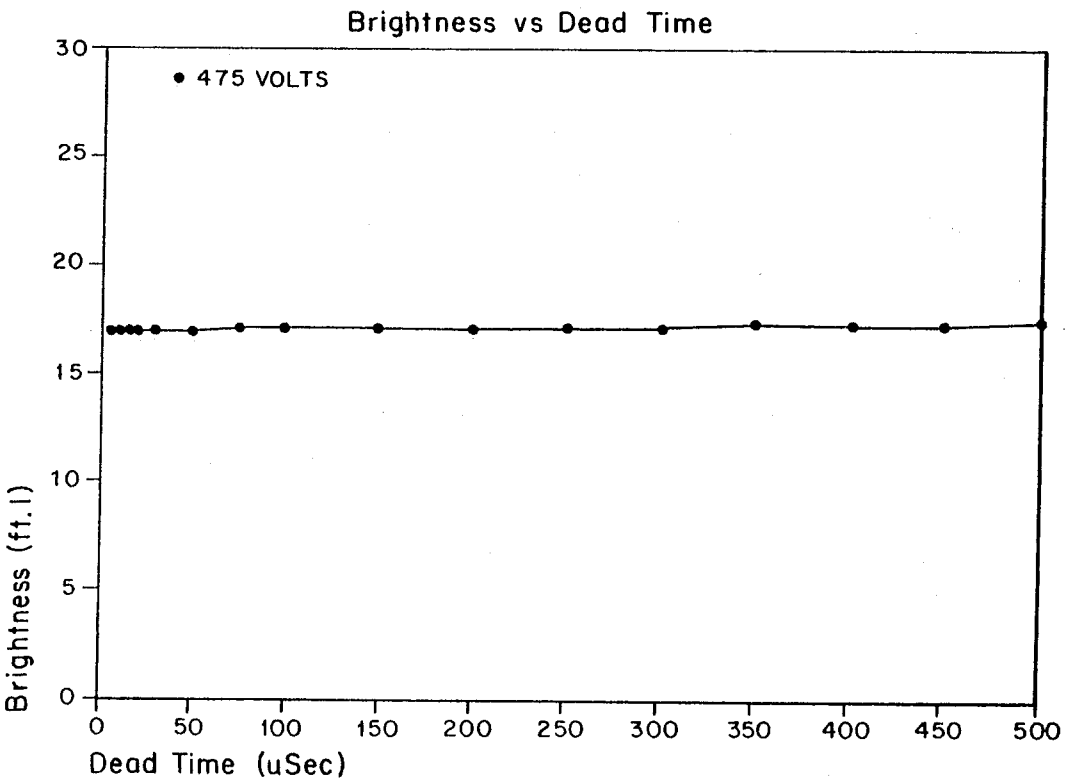
FIG. 3 is a plot of brightness of an EL device as a function of deadtime between pulses applied.
Figure 4:
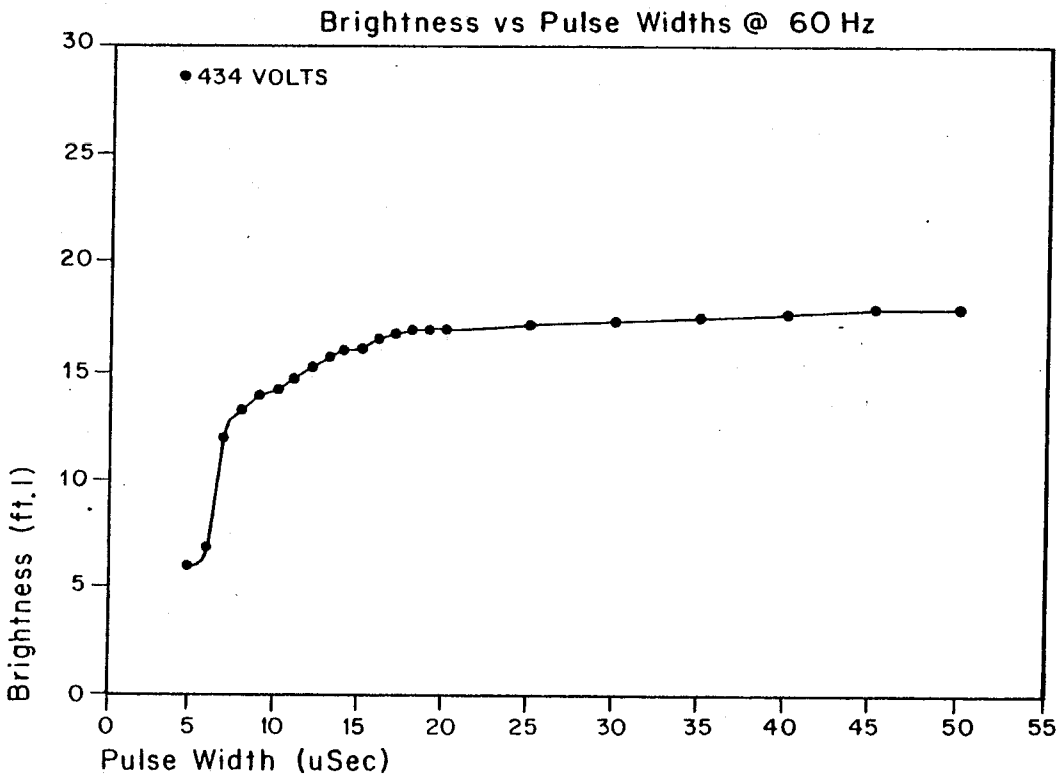
FIG. 4 is a plot of brightness of an EL device as a function of the applied pulse width.

The relationship between applied voltage and light output for an EL Device is shown in FIGS. 1B and 1C. It is assumed that the threshold voltage for light output from the device is 340 volts. When a 400 volt transition (+200 volts to −200 volts) is applied between the terminals 20 and 22, a light output pulse is emitted as shown in FIG. 1C. To produce a second light pulse, a 400 volt transition of opposite polarity is required. To produce a continuous series of light pulses, voltage pulses of amplitude greater than the threshold voltage and of alternating polarity are required. A characteristic of the light output is that it decays relatively slowly after the application of the energizing pulse. With reference to FIG. 1C, the decay time $t_0$ for the light output to decay to 1/e of its initial value, is typically in the range of 0.5 to 1.0 milliseconds.

Utilizing the prior art drive techniques, the light pulses are produced twice per frame for an asymmetric drive technique and once per frame for a symmetric drive technique. As discussed previously, the asymmetric drive technique is undesirable because of the retained image problem. The symmetric drive technique largely eliminates the retained image. However, the brightness is reduced by one half since there is only one light pulse per frame from each selected pixel. For a 60 Hz refresh rate, there is one light pulse every 16.7 milliseconds.

We have discovered that the brightness of the light output pulse can be substantially increased compared to prior art techniques by supplying the EL display device with a burst of short pulses. These pulses are supplied during the time when the light output is normally decaying so as to increase the amplitude of the light output pulse above that which otherwise occurs when a single energizing pulse is applied. One might expect that it would be necessary to allow the phosphor in the EL device to relax to some fraction of peak brightness before a second energizing pulse is applied. However, we found this not to be the case.

The technique for energizing EL devices in accordance with the present invention is demonstrated with references to FIGS. 2–6. In each of FIGS. 2, 4 and 6, energizing pulses were applied to a conventional dot matrix electroluminescent display panel. In a first measurement, pulses of 10 microseconds duration and 400 volts amplitude with a few microseconds between pulses were applied to the EL panel at a 60 Hz repetition rate. The number of pulses applied in a burst was varied. The brightness as a function of the number of pulses seen that the brghtness increases with the number of applied in a burst is plotted in FIG. 2. It can be pulses up to about 35 to 45 pulses before the EL device yields little additional light output.

In a second measurement, the brightness of the display was measured as a function of the deadtime between energizing pulses. As used herein, deadtime is defined as time between the end of one pulse and the start of the next pulse. This parameter is important in driving EL display panels because it is customary to energize the display with pulses of alternating positive and negative polarities with different drivers providing the positive and negative pulses. It is not desirable to have both drivers turned on at the same time. To avoid both drivers being turned on at the same time, a short deadtime between positive and negative pulses is provided. Bursts of 15 microsecond pulses having an amplitude of 475 volts were applied to the display panel at a 60 Hz rate. The brightness of the display as a function of deadtime is plotted in FIG. 3. It was found that there was less than a 5% loss in brightness when the pulses are separated by as little as 1–2 microseconds. It is believed that the deadtime can approach zero without adversely affecting display brightness.

In a further set of measurements, the EL display brightness was measured as a function of applied pulse width. Pulses having an amplitude of 434 volts and variable pulse width were applied to the display at a 60 Hz rate. Brightness as a function of pulse width is plotted in FIG. 4. This measurement shows that the width of a single pulse can be reduced to about 8–12 microseconds without losing more than 20% of the display brightness.

With reference to the measurements of brightness as a function of pulse width and deadtime between pulses, the limiting factor is the time constant required for charging the EL device to a voltage above its threshold voltage with alternating polarity. Thus, longer energizing pulses are required for larger, high capacitance display devices while shorter energizing pulses are sufficient for smaller, lower capacitance devices. The minimum pulse width and spacing between pulses is tailored to the time constant of the EL devices being driven.

Figure 5A:
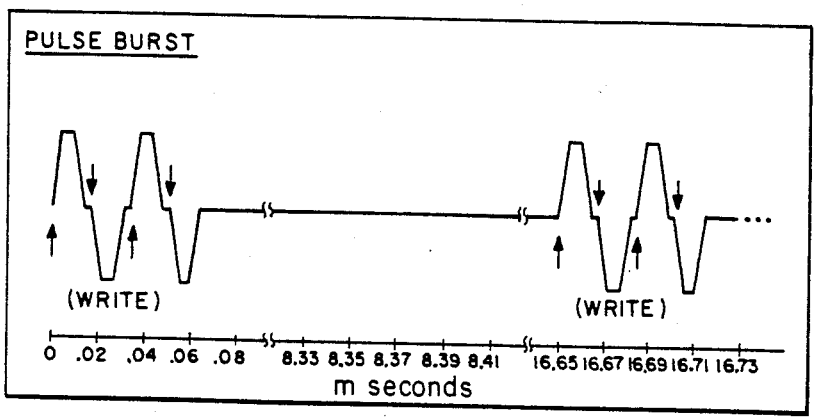
FIG. 5A illustrates the waveform of an energizing pulse burst in accordance with the present invention.
Figure 5B:
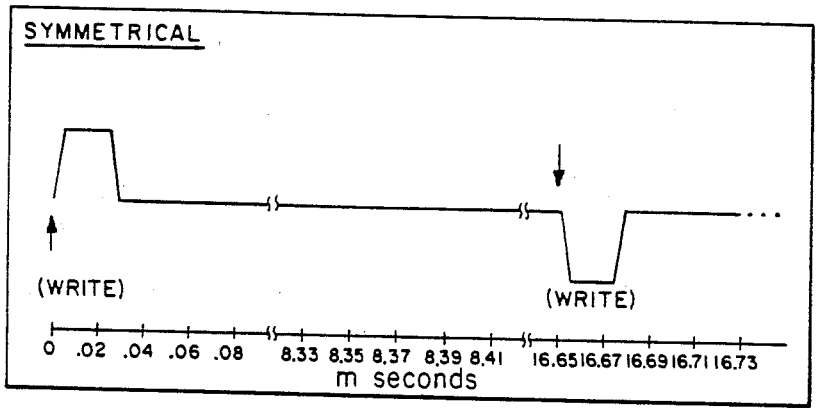
Fig. 5B (PRIOR ART)
FIGS. 5B and 5C illustrate waveforms for energizing an EL device in accordance with the prior art.
Figure 5C:
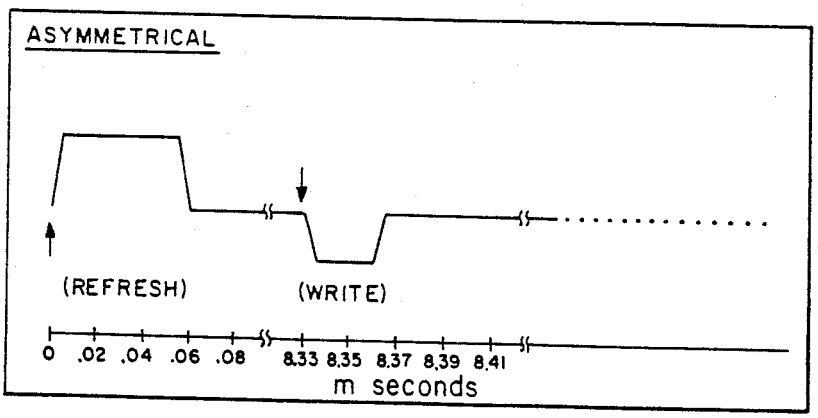
Fig. 5C (PRIOR ART)
Figure 6:
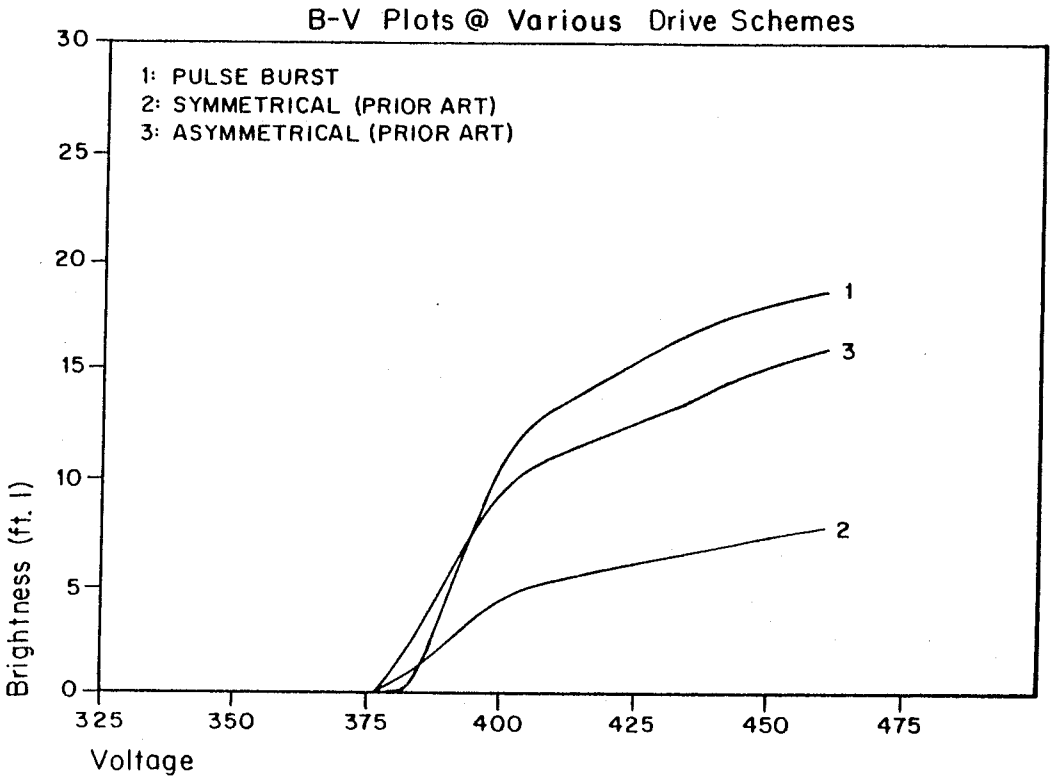
FIG. 6 is a plot of brightness of an EL device as a function of voltage for the waveforms shown in FIG. 5.

In a further set of measurements, the pulse burst technique of the present invention was compared with prior art symmetrical and asymmetrical drive techniques. For the pulse burst technique of the invention, four pulses were applied to the display panel at a 60 Hz refresh rate as shown in FIG. 5A. For the symmetrical technique in accordance with the prior art, pulses of alternating polarity were applied to the display on successive frames at a 60 Hz frame rate, as shown in FIG. 5B. The waveform of the asymmetrical technique includes a refresh pulse and a write pulse during each frame, as shown in FIG. 5C. The results of the three measurements are illustrated in FIG. 6 wherein curve 1 indicates brightness for the pulse burst technique, curve 2 indicates brightness for the symmetrical technique and curve 3 indicates brightness for the asymmetrical technique. In each case, brightness is plotted as a function of applied voltage. The results show that the symmetrical pulse burst excitation technique of the present invention produces nearly 15% more light output than the asymmetrical drive technique of the prior art, and more than double the light output of the symmetric drive technique of the prior art.

Preferably, in accordance with the invention, the energizing pulses include a burst of between 2 and 40 pulses, each having a minimum duration of 5 microseconds. Most preferably, the pulses in the burst have a duration in the range between about 5 and 20 microseconds. It is also preferred that the pulses in the burst have alternating polarity so that the applied voltage is symmetrical about ground potential.

The principle of utilizing a burst of pulses for energizing an EL device is advantageously applied to an EL display panel of practical size. One standard size EL display panel contains 512×256 elements; that is, 512 columns and 256 rows. The pixels of the display are addressed one row at a time, and selected pixels are illuminated by applying a modulating voltage in parallel on the column lines. For a 60 Hz refresh rate, each row is addressed for approximately 65 microseconds per row. During the 65 microsecond address time per row, four pulses of about 12–15 microseconds each are preferably applied to the EL pixels to provide increased brightness.

The pulse burst excitation technique of the present invention can be applied in a number of ways to achieve brightness enhancement. The pulse burst can be extended by adding pulses to increase brightness, depending on the available row time. Smaller panels with less pixels have longer row time and can benefit from longer pulse bursts. In addition, the pulse burst technique can be applied to the prior art asymmetric drive technique to increase brightness. In all of these approaches, the brightness of the EL display is enhanced by the pulse burst technique without changing the 60 Hz refresh rate supplied to the display by the computer or other control device. Furthermore, the brightness of displays utilizing refresh rates greater or less than 60 Hz can be increased by utilizing the pulse burst technique.

Figure 7:
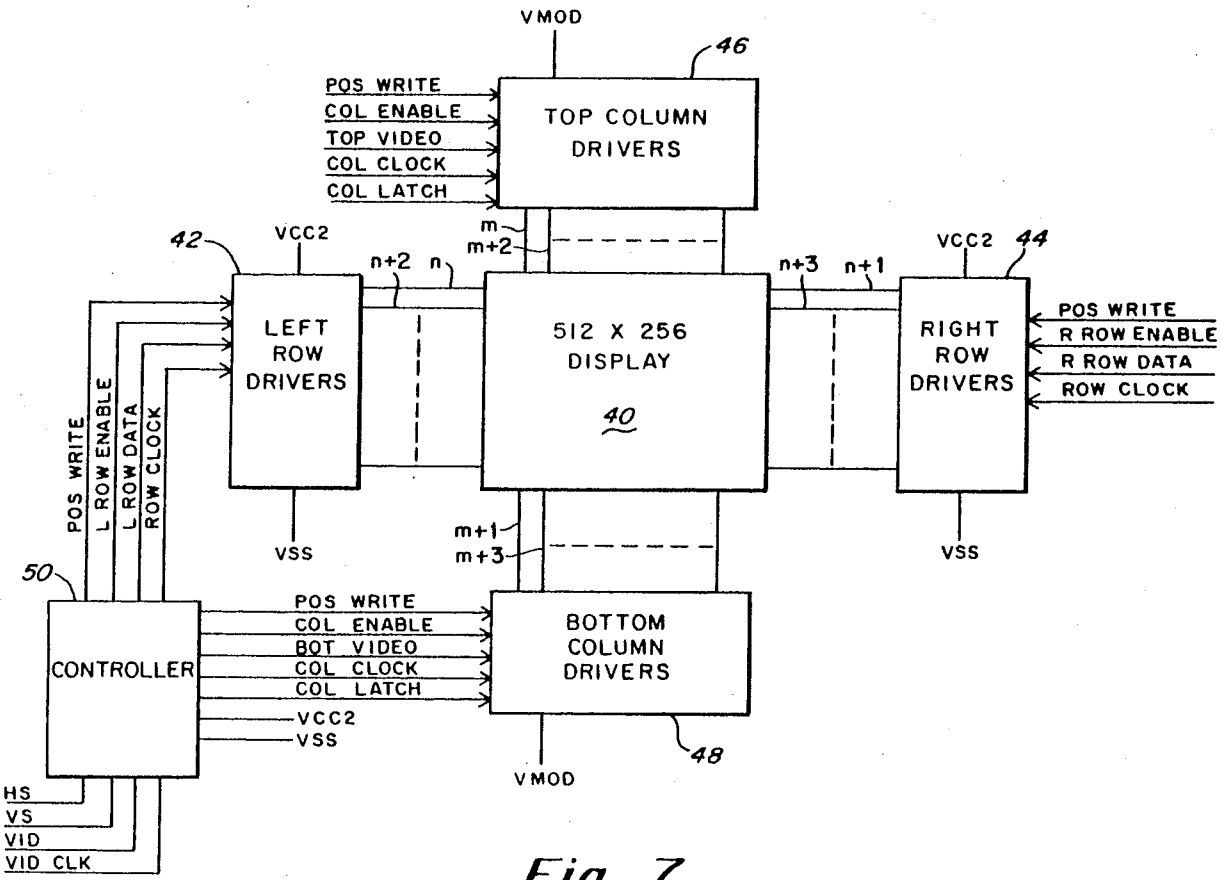
FIG. 7 is a block diagram of an EL display apparatus in accordance with the present invention.
Figure 8:
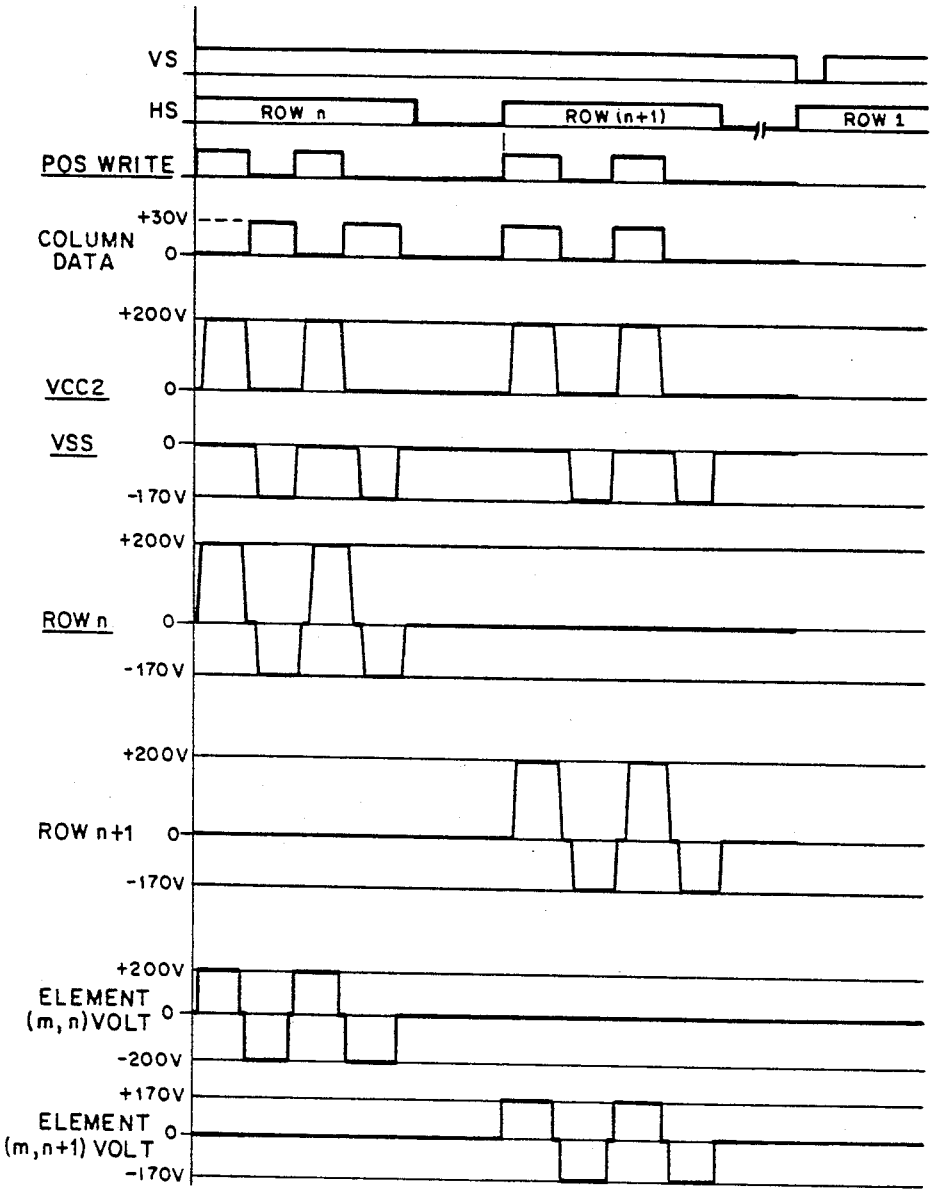
FIG. 8 illustrates waveforms at various points in the EL display apparatus of FIG. 7.
Figure 9:
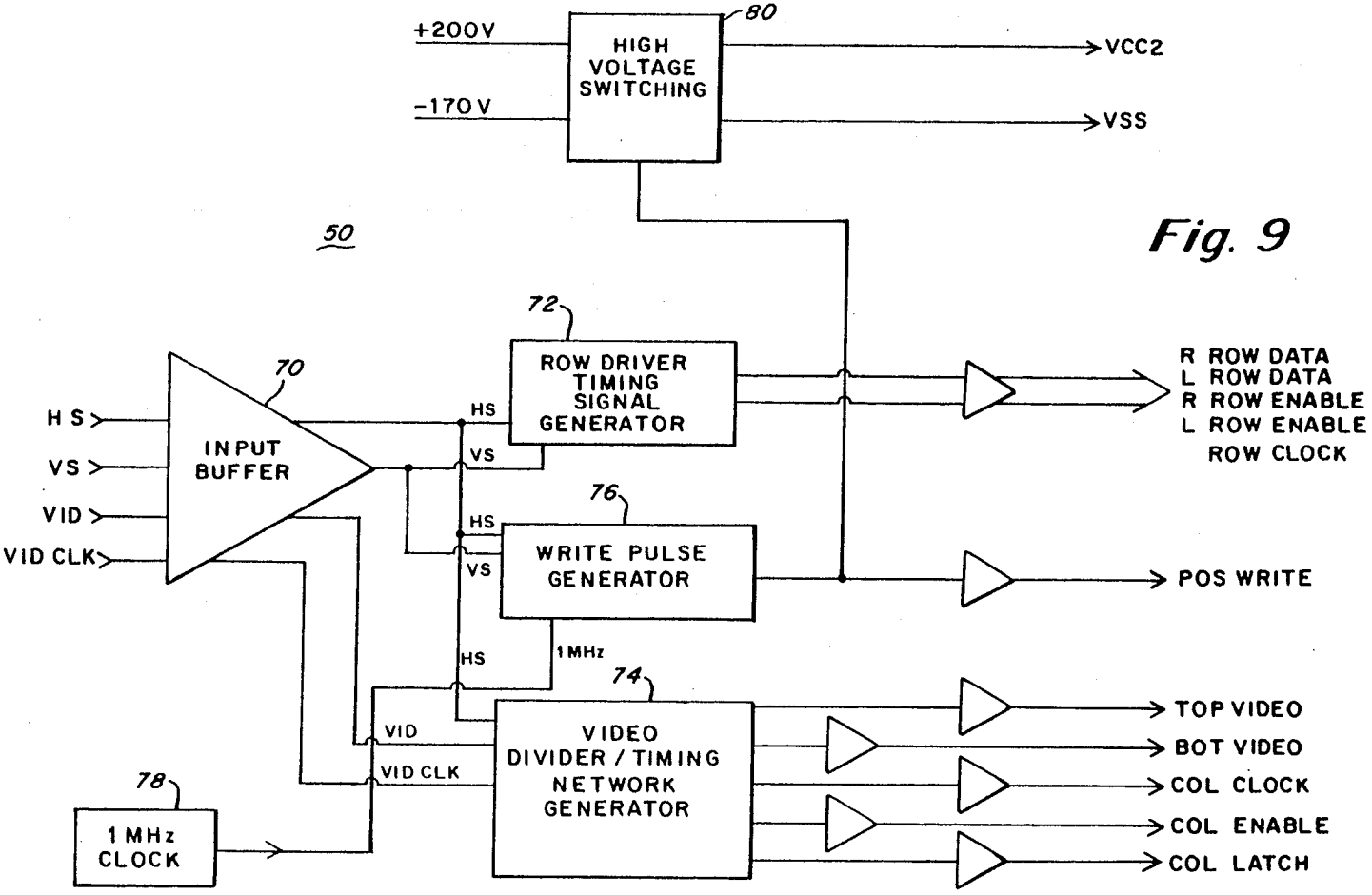
FIG. 9 is a block diagram of the display controller of FIG. 7.
Figure 10:
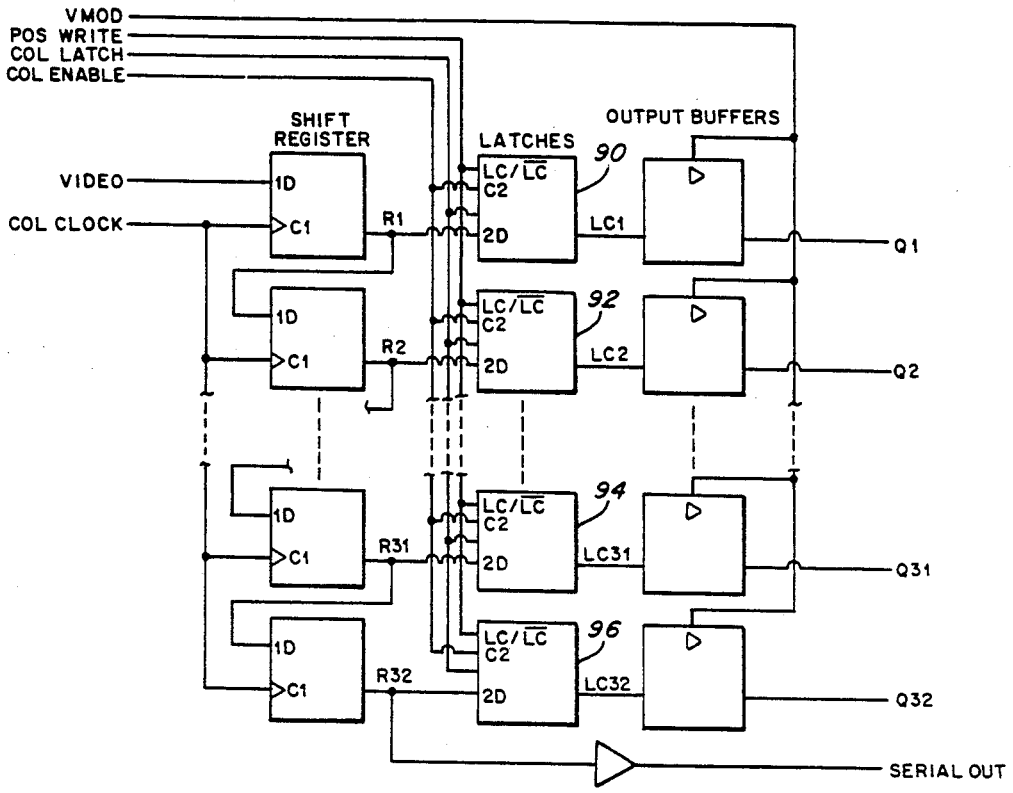
FIG. 10 is a schematic diagram of a modified column driver suitable for use in the apparatus of FIG. 7.

A preferred electroluminescent display panel in accordance with the present invention is illustrated in FIGS. 7–9. An EL display panel 40 comprising 512×256 elements has its 256 rows energized by left row drivers 42 and right row drivers 44 and has its 512 columns energized by top column drivers 46 and bottom column drivers 48. Two sets of row drivers are required because of an interdigitated display panel construction wherein alternating rows of pixels are connected to the left and right sides, respectively. Similarly, alternating columns of pixels are connected to the top and bottom of the display panel, respectively, in an interdigitated construction. The left row drivers 42 can be type 75552 and the right row drivers 44 can be type 75551, each manufactured by Texas Instruments. Similarly, the top column drivers 46 can be type 75553 and the bottom column drivers 48 can be type 75554, each manufactured by Texas Instruments. The top column drivers 46 and the bottom column drivers 48 are modified as shown in FIG. 10 and described hereinafter. Voltages and control signals are supplied to the drivers 42, 44, 46, 48 by a controller 50.

The row drivers 42, 44 include suitable circuitry for driving the pixels of the display 40 at the necessary positive and negative voltages which, in conjunction with the voltages applied to the column conductors, produce illumination of selected pixels. Successive rows are selected by clocking one bit of data into the register of the first row driver on each side of the display. The left row drivers 42 are enabled first, followed by the right row drivers 44. Next, the row drivers 42, 44 are clocked one time and the next left/right pair of rows is selected. Due to the high voltages supplied by the row drivers 42, 44 (typically, in the range of 200 volts), it is preferred to couple signals to the row drivers 42, 44 by optical isolators (not shown). The column drivers 46, 48 store data representing the pixels selected for illumination in the enabled row and modulate the column voltage to illuminate selected pixels.

Voltages supplied to the row drivers 42, 44 include VCC2, which is the positive row voltage supplied to the EL display element, and VSS, which is the negative low voltage supplied to the EL display element. The row drivers receive a ROW CLOCK signal, left and right ROW DATA signals for sequencing through the rows of the display 40, a L ROW ENABLE signal for enabling the left row drivers 42, a R ROW ENABLE signal for enabling the right row drivers 44 and a POS WRITE signal which controls whether the positive or the negative voltage is applied to the display panel 40.

The column drivers 46, 48 receive a VMOD voltage which is the supply for the modulation voltage for selected pixels. The column drivers also receive a COL CLOCK signal, TOP VIDEO and BOT VIDEO signals which are serially loaded into the shift register in the respective column drivers, a COL LATCH signal for transferring the shift register outputs to latches in the column drivers, a COL ENABLE signal for enabling the top or bottom column drivers and the POS WRITE signal for indicating whether true data or inverted data is to be utilized for driving the column conductors of the display panel 40.

Referring now to FIG. 8, the waveforms associated with the EL display apparatus of FIG. 7 are illustrated. A VS signal (vertical synch) received from the host computer occurs once per display frame at a rate of 60 Hz. An HS signal (horizontal synch) received from the host computer includes sequential pulses for enabling each row of the display panel 40. The portion of the HS signal for enabling row n and row n+1 is shown. The HS pulses are utilized to initiate a pulse burst during the scanning of each row of display 40. The controller 50 generates the POS WRITE signal containing multiple pulses during the time that each row is enabled. The POS WRITE signal establishes the timing for the pulse burst. In the present example, four pulses are supplied to each EL pixel during each row enable time.

A block diagram of the controller 50 is shown in FIG. 9. The HS and VS synch signals and VIDEO and VIDEO CLOCK signals received from the host computer are supplied to an input buffer 70. The buffered HS and VS signals are supplied to a row driver timing signal generator 72 which separates the HS synch signals into odd and even rows and provides the L ROW DATA signal, R ROW DATA signal, L ROW ENABLE signal, R ROW ENABLE signal and ROW CLOCK signal. The timing signal generator 72 insures that the left and right row elements of the interdigitated display are energized in synch with the HS synch signal. A video divider/timing network generator 74 performs a similar function with respect to the video data. The video data is separated by generator 74 into top video and bottom video on alternating pulses of the video clock so that the correct elements of the interdigitated columns in the display 40 are illuminated. The generator 74 also provides the COL CLOCK signal, which is the VIDEO CLOCK signal from the host computer divided by two, and the COL LATCH and COL ENABLE signals. The controller 50 further includes a write pulse generator 76 which receives the HS and VS signals and a one megahertz clock signal from a clock generator 78. The write pulse generator 76 generates the pulse burst for energizing the EL display. During each HS synch signal, the POS WRITE signal containing the pulse burst is generated in a conventional manner by a counter timing circuit. The pulse burst is initiated by the leading edge of the HS signal and the one megahertz clock is divided to provide the desired pulse burst sequence. In the present example, the POS WRITE signal comprises a sequence of alternating logic highs and lows, each having a duration of about 12 microseconds to produce a burst of four energizing pulses.

The positive supply and the negative supply for the row drivers are modulated by a high voltage switching circuit 80 controlled by the POS WRITE signal. When POS WRITE is high, +200 volts is supplied on line VCC2 to row drivers 42, 44. When POS WRITE is low during a row enable signal, −170 volts is supplied on line VSS to row drivers 42, 44. These voltages are combined by row drivers 42, 44 to provide a row drive signal as indicated at ROW n in FIG. 8. The ROW n signal includes two positive pulses of +200 volts amplitude and two negative pulses of −170 volts amplitude. The ROW n+1 signal is the same as the ROW n signal but is delayed in time.

The saturation voltage of the EL devices is assumed to be 400 volts. The voltage applied to the row conductors of the display panel 40 primes the EL pixels, but requires a modulation voltage to be applied on the column conductors for saturation and light emission. The POS WRITE signal is also used to control the voltage applied on the column conductors. A typical COLUMN m DATA signal is illustrated in FIG. 8. The COLUMN m DATA signal switches between zero volts and +30 volts. In FIG. 8, the COLUMN m DATA signal during row n illustrates a selected pixel, while the COLUMN m DATA signal during row n+1 illustrates a nonselected pixel. It can be seen that the column drive signal includes four pulses in synchronism with the row enable pulses.

For the selected pixel in row n, column m, it is seen that the COLUMN m DATA signal is zero volts when the row signal is +200 volts, causing a net 200 volts across the EL device. The COLUMN m DATA signal is at +30 volts when the row signal is at −170 volts, also resulting in a net 200 volts being applied across the EL device. Thus, when the row voltage switches from +200 volts to −170 volts, a 400 volt transition is applied to the EL device. Similarly, a 400 volt transition occurs when the row voltage switches from −170 volts to +200 volts.

With reference to row n+1, column m pixel which is not selected, the COLUMN m DATA signal is at +30 volts when the ROW n+1 signal is at +200 volts, resulting in a net 170 volts being applied to the EL device. When the ROW n+1 voltage is −170 volts, the COLUMN m DATA signal is zero volts, resulting in a net 170 volts applied across the terminals of the EL device. In the case of the nonselected pixel, when the ROW n+1 signal goes from +200 volts to −170 volts, a voltage transition of 340 volts is applied across the EL device. Similarly, a 340 volt transition occurs when the ROW n+1 signal goes from −170 volts to +200 volts. The net voltages applied to the EL pixels for selected and nonselected elements are illustrated in FIG. 8 as ELEMENT (m, n) VOLT (selected) and ELEMENT (m, n+1) VOLT (nonselected).

The waveforms shown in FIG. 8 and described hereinabove have several important characteristics. First, the waveforms applied across the EL devices are symmetrical. When an EL pixel is selected, the net applied voltage swings between +200 volts and −200 volts. When an EL pixel is not selected, the net applied voltage swings between +170 volts and −170 volts. Four voltage transitions are applied to selected pixels, causing increased brightness as shown and described hereinabove. Furthermore, the voltages are symmetrical about zero volts, thereby eliminating the problem of retained image.

It will be understood that the particular voltages illustrated in FIG. 8 can be varied within the scope of the present invention. All that is necessary is that the row enable signals and column data signals be selected to provide approximately symmetrical voltages across the terminals of the EL device. Similarly, while four pulses have been illustrated as suitable for a 60 Hz refresh rate and for driving the particular EL device capacitance, more or fewer pulses can be utilized within the scope of the present invention.

A modification to the standard type 75553 and 75554 display driver devices for implementing the present invention is illustrated in FIG. 10. The POS WRITE signal is connected to latches 90, 92, 94, 96 of the display driver device. This modification permits the outputs of the latches 90, 92, 94, 96 to be inverted, causing inversion of the column data signal in accordance with the state of the POS WRITE signal during the pulse bursts as illustrated in FIG. 8.

While there has been shown and described what is at present considered the preferred embodiments of the present invention, it will be obvious to those skilled in the art that various changes and modifications may be made therein without departing from the scope of the invention as defined by the appended claims.

What is claimed is:

1. Electroluminescent display apparatus comprising:

at least one thin film electroluminescent display device comprising a single pixel, said display device having a pair of electrodes and being responsive to the application between the electrodes of a voltage above a light emission threshold voltage to emit a light pulse having a prescribed decay time; and drive means for applying between the electrodes of said display device during a time period not greater than said decay time at least two energizing pulses, each having an amplitude at or above said light emission threshold voltage.

2. Display apparatus as defined in claim 1 wherein said energizing pulses have sufficient duration and repetition rate to charge said display device at least to its threshold voltage with alternating polarity.

3. Display apparatus as defined in claim 1 wherein said energizing pulses have alternating polarities.

4. Display apparatus as defined in claim 3 wherein said energizing pulses are symmetrical with respect to ground potential.

5. Display apparatus as defined in claim 1 wherein said drive means applies to the display device between 2 and 40 energizing pulses in a burst.

6. Display apparatus as defined in claim 5 wherein said energizing pulses have a minimum duration of 5 microseconds.

7. Electroluminescent display apparatus comprising:

a plurality of thin film electroluminescent display devices arranged to form a display panel, each of said display devices comprising a single pixel of said display panel, each display device including a pair of electrodes and being responsive to the application between the electrodes of a voltage above a light emission threshold voltage to emit a light pulses having a prescribed decay time; and drive circuit means for time multiplexed energizing of selected display devices during sequential time intervals of a display frame to form a desired image on said display panel, said drive circuit means including means for applying between the electrodes of each selected display device during one of said time intervals at least two energizing pulses, each having an amplitude at or above said light emission threshold voltage, said at least two energizing pulses being applied to said selected display device during a time period not greater than said decay time.

8. Electroluminescent display apparatus comprising:

a plurality of thin film electroluminescent display devices arranged in rows and columns to form a display panel, each of said display devices comprising a single pixel of said display panel, each display device comprising a pair of electrodes and being responsive to the application between the electrodes of a voltage above a light emission threshold voltage to emit a light pulse having a prescribed decay time, each display device having one electrode connected to a row conductor for the row in which it is located and the other electrode connected to a column conductor for the column in which it is located;

row driver circuit means for sequentially energizing row conductors of said display panel during sequential time intervals of a display frame;

column driver circuit means for energizing selected display devices in the row addressed by said row driver circuit means so as to form a desired image on said display panel;

said row driver circuit means and said column driver circuit means including means for applying between the electrodes of each selected display device during one of said time intervals at least two energizing pulses, each having an amplitude at or above said light emission threshold voltage, said at least two energizing pulses being applied to said selected display device during a time period not greater than said decay time.

9. Display apparatus as defined in claim 8 wherein said energizing pulses have sufficient duration and repetition rate to charge selected display devices at least to their threshold voltage with alternating polarity.

10. Display apparatus as defined in claim 8 wherein said energizing pulses have alternating polarities.

11. Display apparatus as defined in claim 10 wherein said energizing pulses are symmetrical with respect to ground potential.

12. Display apparatus as defined in claim 8 wherein said row driver circuit means and said column driver circuit means apply to the display device between 2 and 40 energizing pulses in a burst.

13. Display apparatus as defined in claim 12 wherein said energizing pulses have a minimum duration of 5 microseconds.

14. Display apparatus as defined in claim 11 including means for operating said display panel at a 60 Hz refresh rate and wherein said drive means supplies four energizing pulses during each of said time intervals.

15. A method for energizing an electroluminescent display panel comprising a plurality of thin film electroluminescent display devices, each of said display devices comprising a single pixel of said display panel, each display device having a pair of electrodes and being responsive to the application between the electrodes of a voltage above a light emission threshold voltage to emit a light pulse having a prescribed decay time, said method comprising the steps of:

energizing said display devices during sequential time intervals of a display frame to form a desired image on said display panel; and applying between the electrodes of each selected display device during one of the time intervals at least two energizing pulses, each having an amplitude at or above said light emission threshold voltage, said at least two energizing pulses being applied to each selected display device during a time period not greater than said decay time.

16. A method for energizing an electroluminescent display panel as defined in claim 15 wherein the step of applying at least two energizing pulses includes the step of applying a burst of between two and forty energizing pulses.

17. A method for energizing an electroluminescent display panel as defined in claim 16 wherein the step of applying a burst of between two and forty energizing pulses includes the step of alternating the polarity of the energizing pulses.

18. A method for energizing an electroluminescent display panel as defined in claim 16 wherein the step of applying a burst of between two and forty energizing pulses includes the step of alternating the polarity of the pulses so that the burst of pulses is symmetrical with respect to ground potential.

19. A method for energizing a thin film electroluminescent display device comprising a single pixel, said display device having a pair of electrodes and being responsive to the application between the electrodes of a voltage above a light emission threshold voltage to emit a light pulse having a prescribed decay time, said method comprising the step of applying between the electrodes of the electroluminescent display device during a time period not greater than said decay time, a burst of at least two energizing pulses, each having amplitude at or above said light emission threshold voltage.

20. A method for energizing an electroluminescent display device as defined in claim 19 wherein the step of applying a burst of energizing pulses includes the step of applying a burst of between two and forty energizing pulses during said decay time.

* * * * *